US006915948B2

(12) United States Patent
George

(10) Patent No.: US 6,915,948 B2
(45) Date of Patent: Jul. 12, 2005

(54) COLLAPSIBLE/EASILY DISPOSABLE FOOD CONTAINER

(76) Inventor: Nadim William George, P.O. Box 251752, Los Angeles, CA (US) 90025

( * ) Notice: Subject to any disclaimer, the term of this patent is extended or adjusted under 35 U.S.C. 154(b) by 0 days.

(21) Appl. No.: 10/424,935

(22) Filed: Apr. 29, 2003

(65) Prior Publication Data

US 2004/0217154 A1 Nov. 4, 2004

(51) Int. Cl.[7] ..... B65D 5/36

(52) U.S. Cl. ..... 229/117.01; 229/906; 229/117.05; 229/930

(58) Field of Search ..... 229/117.01, 930, 229/101, 117.05, 960

(56) References Cited

U.S. PATENT DOCUMENTS 1,135,117 A * 4/1915 Lafore ..... 229/117.01
5,197,659 A * 3/1993 Vassiliou ..... 229/117.01
5,209,392 A * 5/1993 Anatro ..... 229/117.01
5,273,206 A * 12/1993 Vassiliou ..... 229/117.01
5,305,949 A * 4/1994 Linden ..... 229/117.01
5,476,216 A * 12/1995 Robertella et al. ..... 229/117.01
D390,110 S * 2/1998 Mario
6,386,440 B1 * 5/2002 Tulkoff ..... 229/120.32

* cited by examiner

*Primary Examiner*—Tri M. Mai

(57) ABSTRACT

Collapsible food containers of this invention comprise an upper and lower panel, each including a leading edge at a front portion of each panel, and a trailing edge at a rear portion of each panel. Each trailing edge is connected together by a rear panel interposed therebetween. Each panel further comprises side edges that are opposite one another and that extend between the leading edge and the trailing edge of each upper and lower panel. The container includes a first relief disposed along a surface of at least one of the upper or lower panels. The first relief extends along an axis running between opposed side edges to form a container first fold area to reduce the size of the container by approximately one half. The container can include a second relief that is disposed along a surface of at least one of the upper or lower panels. The second relief extends along an axis running perpendicular to the axis defining the first relief to form a second fold area to facilitate folding the container about the second fold area to reduce the size of the container by approximately one quarter.

25 Claims, 9 Drawing Sheets

COLLAPSIBLE/EASILY DISPOSABLE FOOD CONTAINER

FIELD OF THE INVENTION

This invention relates to containers that are used for transporting and/or storing food items and, more particularly, to a container that is used for transporting and/or storing a pizza and that is specially configured to facilitate easy and space efficient disposal.

BACKGROUND OF THE INVENTION

Containers used to transport and/or store food are well known in the art. A widely known example of such container is one that is used to transport and/or store a pizza, referred to hereafter as a pizza-style container or pizza box. Conventional pizza boxes are made out of cardboard or paperboard and are shaped, when assembled, having a generally square configuration. Pizza boxes are typically formed from a sheet stock that is configured to be folded at the point of use in a manner that provides a clamshell-type assembled construction that is capable of accommodating a pizza. In its assembled state, the conventional pizza box is configured having length and width dimensions that are approximately the same, and that are slightly larger that the radius of the particular pizza, and having a low profile height dimension, that is sized greater than the thickness of the particular pizza.

Conventional pizza boxes are intended for one-time use in transporting the pizza from the point of origination to the point of consumption. Once the pizza is consumed or removed from the box, the box is discarded by placement into the trash. A problem known to occur with such pizza boxes is that their size and shape makes them difficult to dispose of in a simple manner. Typically, the size and shape of the assembled pizza box makes it difficult to place the box in a conventionally-sized kitchen trash can. More often than not, the size and shape of the pizza box requires the user to take an extra effort in disposing of the box by carrying it separately to a larger household trash container, such as a large trash barrel stored outside of the house.

It is, therefore, desirable that a food container, e.g., pizza box, be constructed in a manner that accommodates easy and space efficient handling and disposal after the food product has been removed therefrom. It is desired that such food container be constructed to provide such feature without adversely impacting the container=s ability to transport and store the food product. It is desired that such food container be made from readily available materials, and be formed by using available methods.

SUMMARY OF THE INVENTION

Collapsible food containers are constructed according to principles of this invention to accommodate easy and space efficient storage and/or disposal. Collapsible food containers of this invention generally comprise an upper and lower panel. Each upper and lower panel include a leading edge at a front portion of each panel, and a trailing edge at a rear portion of each panel. The trailing edge of each panel is connected together by a rear panel interposed therebetween. Each panel further comprises side edges that are opposite one another and that extend between the leading edge and the trailing edge of each upper and lower panel. Configured in this manner, various edges of the upper and lower panel can be folded to provide a box-like structure suitable for containing a food article therein.

The container includes a first relief disposed along a surface of at least one of the upper or lower panels. The first relief extends along an axis running between opposed side edges to form a container first fold area. In an example embodiment, the first relief is positioned near a midpoint between the leading edge and trailing edge. The first relief facilitates folding the container about the first fold area to reduce the size of the container by approximately one half.

If further container size reduction is desired, the container can include a second relief that is disposed along a surface of at least one of the upper or lower panels. The second relief extends along an axis running perpendicular to the axis defining the first relief to form a second fold area. In an example embodiment, the second relief is positioned near a midpoint between the opposed side edges. The second relief facilitates folding the container about the second fold area to reduce the size of the container by approximately one quarter.

The container can further include an attaching means integral or nonintegral with one or both of the upper and lower panels for attaching adjacent portions of the container together when the container is folded two times about the first and second reliefs. Configured in this manner, containers of this manner enable easy size reduction to purposes of easy handling and space efficient storage and/or disposal.

BRIEF DESCRIPTION OF THE DRAWING

These and other features, aspects, and advantages of the present invention will be more fully understood when considered with respect to the following detailed description, appended claims, and accompanying drawings, wherein:

DETAILED DESCRIPTION OF THE INVENTION

Collapsible food containers of this invention are initially provided in the form of a flat construction that is folded and/or otherwise manipulated to provide an assembled box-like form that is suitable to contain and/or transport a desired food product. In an example embodiment, the desired food product is a pizza, and the food collapsible food container is a pizza-style container or pizza box that is sized and shaped to accommodate the same. Pizza boxes of this invention are specially constructed to facilitate reduced in size, by approximately one quarter of its assembled size, to permit easy handling and space efficient disposal once the pizza is removed.

Figure 1:
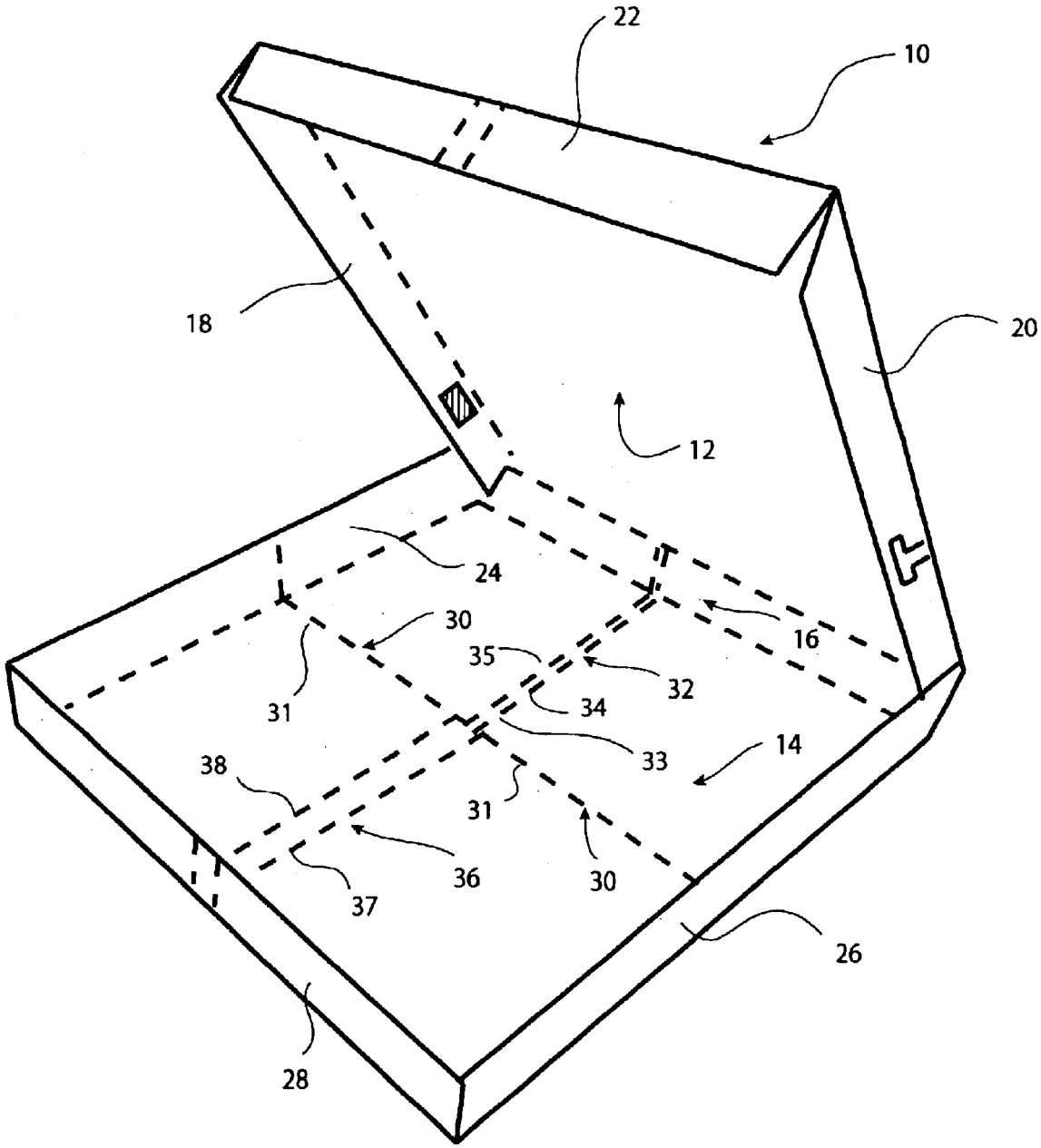
FIG. 1 is a perspective front view of a collapsible food container constructed according to principles of this invention in assembled form.

FIG. 1 illustrates a collapsible food container 10 of this invention in an assembled state for receiving a food product. In the embodiment shown, the collapsible food container 10 is the form of a box-like pizza-style container or pizza box ready to receive a pizza. While a particular type of pizza-style container will be disclosed and illustrated, it is to be understood that the collapsible features of this invention are intended to be used with any type of pizza-style box or food container that is configured in the same general manner to accommodate a pizza. Pizza boxes of this invention can be formed from paper, paper board, cardboard, or other type of material commonly used to form pizza boxes.

The collapsible food container 10 generally comprises a flat upper panel 12 or lid, and a flat lower panel 14 or base that are connected together by a common rear side panel 16. The upper panel 12 includes two diametrically opposed upper side panels 18 and 20 that each project outwardly away therefrom in a perpendicular manner. An upper front side panel 22 projects outwardly away from a frontwardy facing leading edge of the upper panel 12, and is diametrically opposed to the rear side panel 16. The upper side and upper front side panels are each formed from folded otherwise flat edge sections of the container upper panel 12.

Like the front panel, the lower panel 14 also includes two diametrically opposed lower side panels 24 and 26 that each project outwardly away therefrom in a perpendicular manner. A lower front side panel 28 projects outwardly away from a frontwardy facing leading edge of the lower panel 14, and is diametrically opposed to the rear side panel 16. The lower side and front side panels are each formed from folded otherwise flat edge sections of the container lower panel 14. The side panels of the upper and lower panels 12 and 14 are constructed in a conventional manner to provide the desired container box shape by folding technique, and by cooperative shaping and placement of side panel edge portions to provide container corners.

The collapsible food container lower panel 14 includes one or more reliefs that are positioned along predetermined locations for purposes of facilitating folding the container in a predetermined manner to achieve the desired one quarter size reduction. In an example embodiment, the reliefs are provided in the form of perforations made in the lower panel surface. The perforations can be provided in an inside surface of the lower panel, an outside surface of the lower panel, or along both the inside and outside surfaces of the lower panel. In a preferred embodiment, the perforations are made along the inside surface of the lower panel to permit the preferential folding of the lower panel in a desired manner without substantially detracting from the lower panel's ability to accommodate and carry the food product.

Generally speaking, the reliefs are provided in a manner that operate to facilitate the preferential folding of the lower panel two times upon itself to achieve a one quarter reduction in size. The lower panel can have one or two reliefs to achieve this purpose. In a preferred embodiment, the lower panel 14 comprises two reliefs; namely, a first relief 30 extending along an axis defined between lower side panels 24 and 26, and a second relief 32 extending along an axis that is perpendicular to the axis of the first relief, e.g., between the front and rear side panels 28 and 16. Alternatively, the positioning of the first and second reliefs can be interchanged. A key feature is that the reliefs be positioned to facilitate preferential folding of the lower panel 14 twice to achieve a one quarter size reduction.

Figure 3:
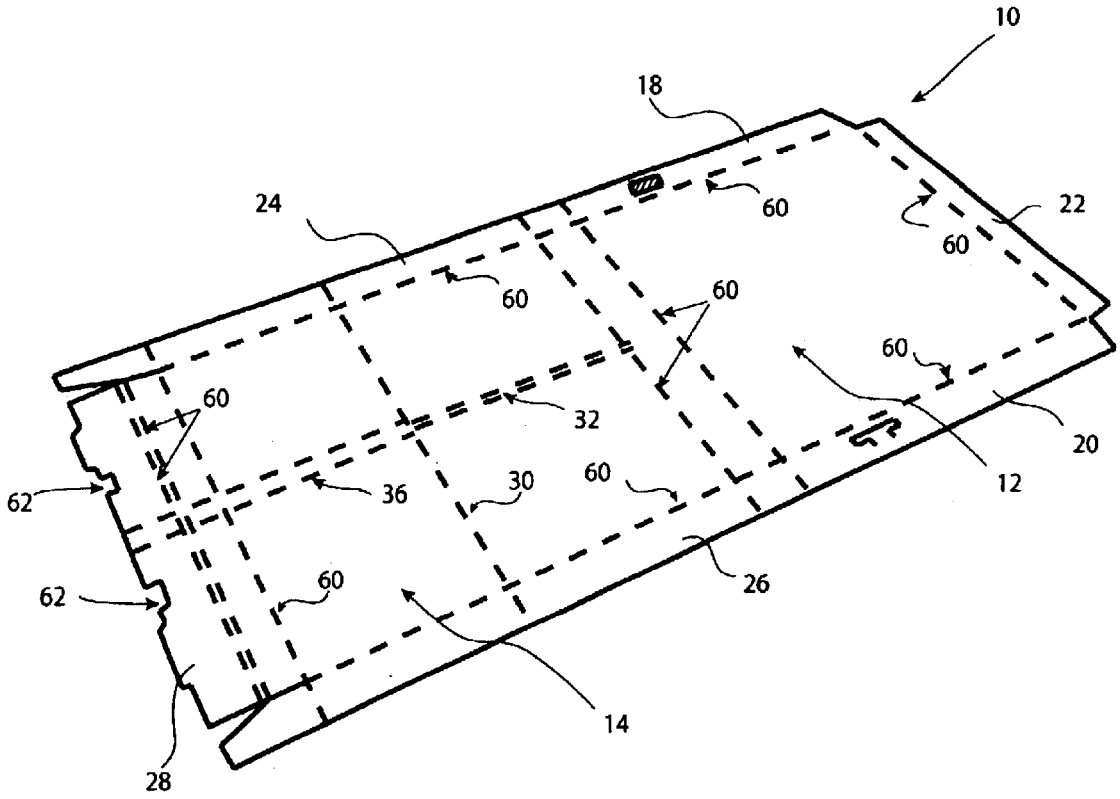
FIG. 3 is a top plan view of an inside surface the collapsible food container of FIG. 1 in unassembled form.

Referring to FIGS. 1 and 3, in the example embodiment, the first relief 30 is positioned along an approximate midpoint between the lower front side panel 28 and the rear side panel 16, and is in the form of a single sequence of perforations or cuts 31 formed in the lower panel surface. The first relief is configured to facilitate a first folding of the container in half by forming a first fold area. In an example embodiment, the first relief perforations 31 are formed along an inside surface of the lower panel for the purpose of retaining the structural integrity of the lower panel for carrying a pizza. It has been discovered that a perforated surface is less likely to collapse upon itself than it is to break away. Thus, for purposes of maintaining the structural integrity of the container for carrying a pizza the perforations are preferably positioned along the lower panel inside surface.

Although a particular type of relief has been described and illustrated, e.g., in the form of a perforation, it is to be understood that other types of known relief embodiments can be used within the spirit of this invention. As used herein, the term relief is understood to include any and all surface treatments known to permit a preferential folding and/or tearing, such as fold lines, separation lines, perforations or a series of cuts, and the like.

The second relief 32 extends along the lower panel 14 in a direction perpendicular to the first relief 30 from the front and rear side panels 28 and 16, and is positioned along an approximate midpoint between the lower side panels 24 and 26. The second relief 32 can be formed from a single series of perforations or cuts like the first relief, or can comprise two or more sections that are configured differently. The second relief 32 is configured to facilitate a second folding of the container, after it has already been folded in half about the first relief, by forming a second fold area. Since the thickness of the container is doubled for this second folding, it is desired that the second relief 32 be configured to facilitate desired preferential folding of this increased thickness portion.

In an example embodiment the second relief 32 comprises two different sections; namely a first section 33 that extends from the first relief 30 to the rear side panel 16, and a second section 36 that extends from the first relief 30 to the front side panel 28. In an example embodiment, the first section 33 is formed from a dual series of parallel oriented perforations or cuts 34 and 35 that are spaced apart a desired degree to facilitate preferential folding of the lower panel, and the second section 36 is formed from a dual series of parallel oriented perforations or cuts 37 and 38 that are spaced apart a desired degree to facilitate preferential folding of the lower panel. Although the section 33 and 36 can be formed from a single sequence of perforations, a dual sequence of perforations is preferred to accommodate an increased thickness of a second folded edge section of the container lower panel when it is being collapsed, as will be described in greater detail below. Thus, it is desired that the perforations 34 and 35, 37 and 38 be spaced apart a sufficient distance to accommodate such increased edge thickness.

Figure 2:
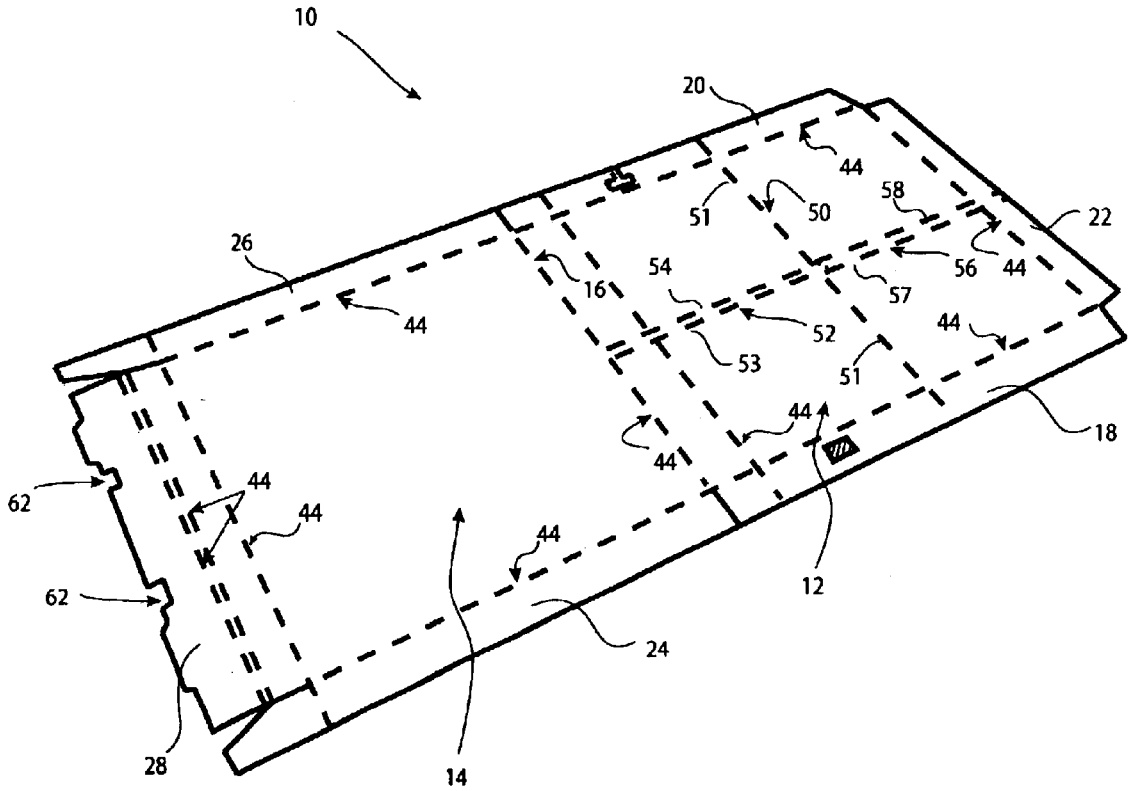
FIG. 2 is a top plan view of an outside surface the collapsible food container of FIG. 1 in unassembled form.

FIG. 2 illustrates the collapsible food container 10 of this invention in an unassembled state, looking down onto outside surfaces of the upper panel 12 and lower panel 14. The upper and lower front side panels 22 and 28, respectively, are shown in their unfolded state, as is the upper and lower side panels 18, 20, and 24, 26, respectively. The side panels are provided as edge portions of their respective upper and lower panels that are folded during container assembly along respective reliefs 44 to form the desired container side construction.

Like the container lower panel, the collapsible food container upper panel 12 includes one or more reliefs that are positioned along predetermined locations for purposes of facilitating folding the container in a predetermined manner to achieve a desired one quarters size reduction. In an example embodiment, the reliefs are provided in the form of perforations or cuts made in the upper panel surface. The perforations can be provided in an inside surface of the upper panel, an outside surface of the upper panel, or in both the inside and outside surfaces of the upper panel. In a preferred embodiment, the perforations are made along the outside surface of the upper panel. It is desired that the perforations be oriented to permit the preferential folding of the upper panel in a desired manner without substantially detracting from the upper panel's ability to operate as a lid on the container and provide ancillary structural support.

In a preferred embodiment, the upper panel 12 comprises a first relief 50 that is in the form of a substantially straight line extending between upper panel side panels 18 and 20. The first relief 50 is positioned approximately along a midpoint between the upper front side panel 22 and the rear side panel 16, and is in the form of a sequence of perforations or cuts 51 in the upper panel surface. The upper panel first relief 50 is positioned to align with the lower panel first relief 30 (in FIGS. 1 and 3) when the container is assembled and closed with the upper panel positioned over the lower panel. Forming the upper panel first relief 50 along an upper panel outside surface, and forming the lower panel first relief 30 along a lower panel inside surface, operates to provide a first fold area for preferential folding of the upper panel downwardly over the lower panel about the respective first reliefs to fold the container in half, i.e., a first step of collapsing the container to its desired one quarter size.

The upper panel 12 includes a second relief 52 in the form of a substantially straight line that is perpendicular to the first relief 50, and that extends from the rear side panel 16 to the front side panel 22. In an example embodiment, the second relief 52 extends through the rear side panel 16 and the front side panel 22 for purpose of further accommodating easy folding of the container through all panel members for easing folding collapsibility of the container. The second relief is positioned at or near a midpoint between the upper panel side panels 18 and 20. The second relief 52 can comprise one or more sections, and can comprise a single or multiple sequence of perforations or cuts. In an example embodiment, the second relief 52 comprises a first section that extends between the first relief 51 and the rear side panel 16, and a second section 56 that extends from the first relief 51 to the front side panel 22.

In a preferred embodiment, the first section comprises a dual sequences of perforations or cuts 53 and 54 that are arranged in parallel with one another. The dual sequence of perforations operate to provide an increased relieved area to provide a second fold area to accommodate preferential folding of an inside edge of an doubled portion of the container upon itself. Thus, it is desired that the perforations 53 and 54 be spaced apart a sufficient distance to accommodate an increased edge thickness of such doubled container. Like the first relief 50, in a preferred embodiment, the second relief 52 is also disposed along the upper panel outside surface. The upper panel second relief 52 is positioned to align with the lower panel second relief 32 (in FIGS. 1 and 3) when the container is assembled and closed with the upper panel positioned over the lower panel, thereby together forming second fold areas.

The upper panel 12 second relief second section 56 is in the form of a substantially straight line extending rearwardly in the container from the upper front side panel 22 to the first relief 50. The second relief second section 56 is positioned at or near a midpoint between the upper side panels 18 and 20. The second section 56 can comprise a single or multiple sequence of perforations or cuts in the upper panel surface. In a preferred embodiment, the second relief second section 56 comprises dual sequences of perforations or cuts 57 and 58 that are arranged parallel with one another. The upper panel second relief second section 56 is positioned to align with the lower panel second relief second section 56 (in FIGS. 1 and 3) when the container is assembled and closed with the upper panel positioned over the lower panel, together forming a second fold area.

In a preferred embodiment, the second relief second section 56 is disposed along the upper panel outside surface. The dual sequence of perforations or cuts are spaced a sufficient distance from one another to accommodate a further increased thickness of an outside second folded edge section of the upper panel when it is being collapsed. In a preferred embodiment, the perforations of the second relief second section 56 are spaced apart a distance greater than the distance separating the perforations 33 and 34 of the second relief first section.

FIG. 3 illustrates the collapsible container 10 of this invention in an unassembled state, looking down onto inside surfaces of the upper panel 12 and lower panel 14. The upper and lower front side panels 22 and 28, respectively, are shown in their unfolded state, as is the upper and lower side panels 18, 20, and 24, 26, respectively. The side panels are provided as edge portions of their respective upper and lower panels that are folded during container assembly along respective reliefs 60 to form the desired container side construction.

FIG. 3 also illustrates the location and nature of the first relief 30, and the second relief first and second sections 32 and 36 disposed along the inside surface of the lower panel 14. The second relief second section 36 extends from the first relief 30 to the lower front side panel 28. In an example embodiment, the second relief second section 36 extends across the lower front side panel 28 to facilitate easy preferential folding of the container.

Referring to FIG. 3, the container 10 is assembled for carrying and transporting a pizza by folding the lower panel side panels 26 and 24 inwardly along reliefs 60. The lower panel front side panel 28 is then folded inwardly twice over to both capture end portions of the side panels 26 and 24, and releasibly lock into place with the lower panel by, e.g., tongue in groove attachment. In this manner, the lower panel is assembled to form a box-like construction.

The upper panel 12 side panels 18 and 20, and the front side panel 22 are folded inwardly along reliefs 60. The upper panel is closed over the assembled lower panel so that the folded front side panel 22 fits inside of the lower panel front side panel 28. Unlike the lower panel, the upper panel may or may not be assembled into a rigid box structure, i.e., having rigid corner features, depending on the particular box configuration.

It is to be understood that the container disclosed above has many conventional features, e.g., side panels and front side panels, that may be configured differently depending on the particular box manufacturer. It is intended that the collapsible feature of this invention can be used with all such differently configured food containers.

Figure 4:
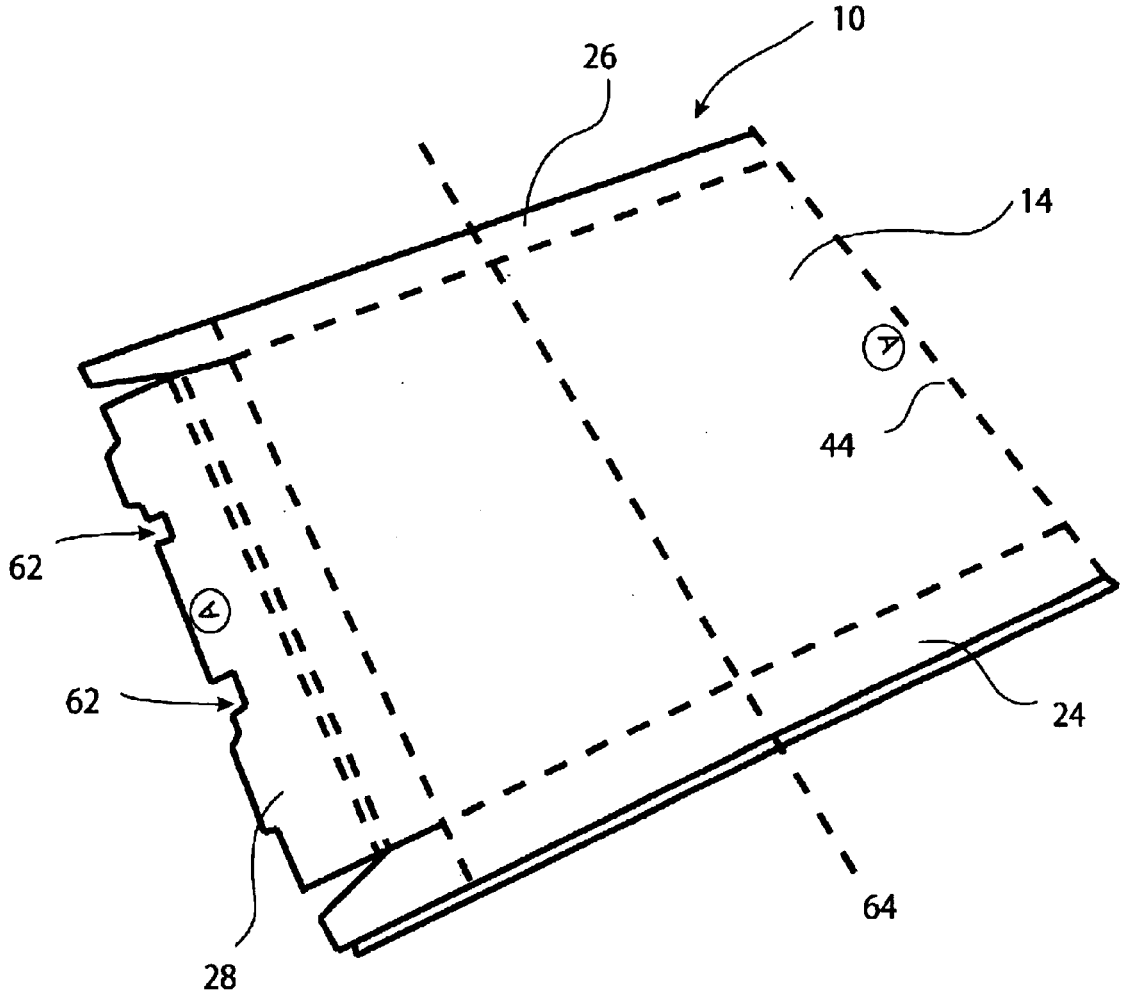
FIG. 4 is a bottom plan view of a lower panel outside surface of the collapsible food container of FIG. 1 after the upper panel has been collapsed onto the lower panel.

The food container of this invention is specially configured to collapse into approximately one quarter of its assembled sized in the following manner. FIG. 4 illustrates the collapsible food container of this invention 10, looking at an outside surface of the lower panel 14, after the upper panel has been collapsed onto the lower panel. The container is placed into this condition by first removing/disengaging the lower panel front side panel 28 from its attached state.

To enable such disengagement, the lower panel front side panel 28 is configured having means for releasing its attachment with the lower panel. In a preferred embodiment, such releasing means is in the form of one or more slots or openings 62 (FIGS. 2 and 3) that are positioned along a terminal edge portion of the front side panel to enable a person to insert one or more fingers underneath of a folded portion of the front side panel to pull the front side panel away from its connection with the lower panel, e.g., to disengage a front side panel tongue from a complementary groove in the lower panel. Once the terminal edge of the front side panel 28 is disengaged with the lower panel, the lower panel side panels 24 and 26 are released from their capture, and the front side panel and side panels are folded back into a flat position that is planar with the rest of the lower panel as shown.

Figure 5:
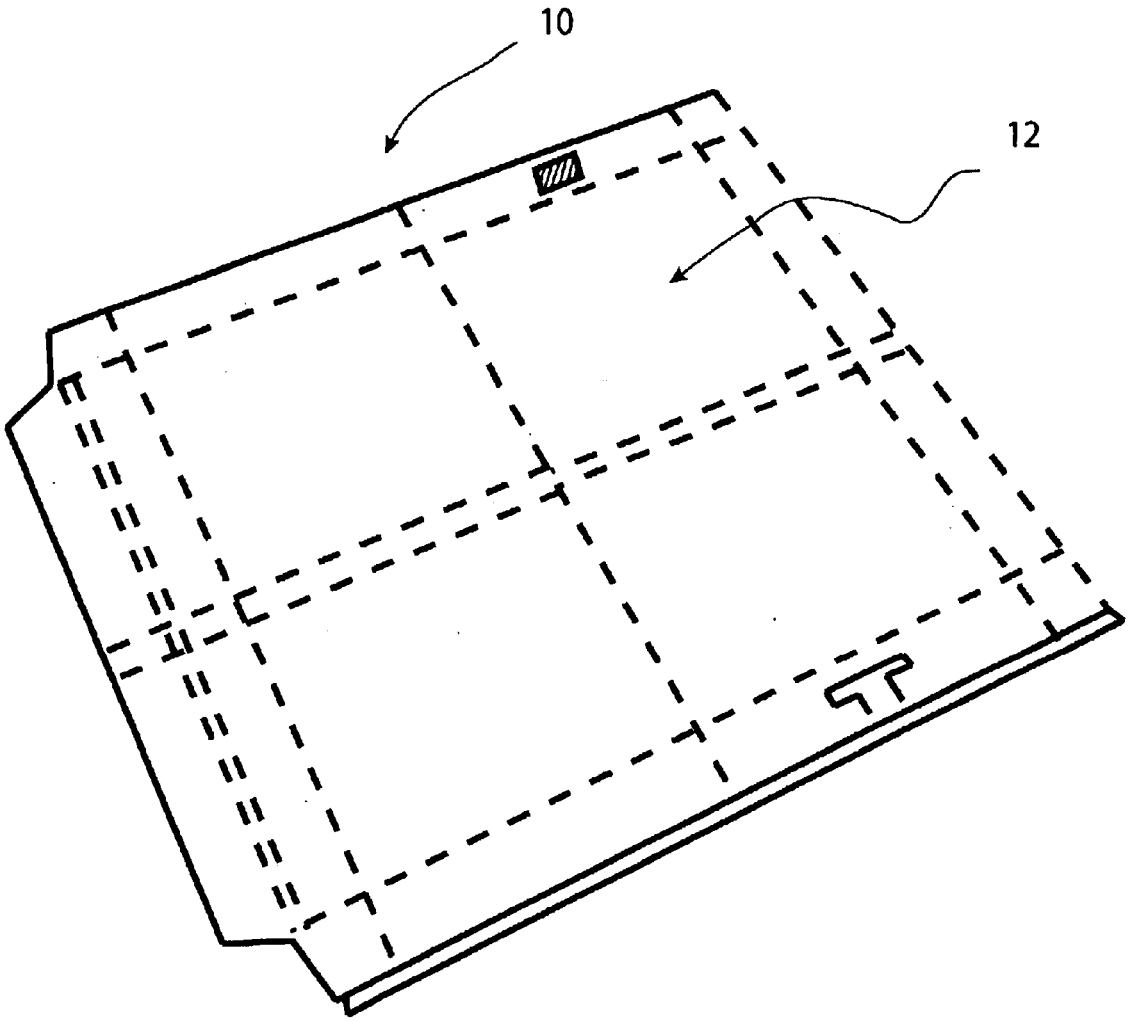
FIG. 5 is a top plan view of an upper panel outside surface of the collapsible food container of FIG. 4, after the upper panel has been collapsed onto the lower panel.

The upper panel 12 is then collapsed over the now collapsed lower panel by folding along the relief 44 positioned between the lower panel 14 and the rear side panel. FIG. 5 illustrates the container 10 of this invention, looking downward onto the upper panel 12 outside surface, after the container has been collapsed and folded in the manner described above.

Referring back to FIG. 4, once collapsed, the container 10 is folded in half across axis 64 by connecting point A, noted on the lower panel front side panel 28, to the point A, noted adjacent the rear side panel relief 44. This first fold is accommodated by first fold areas formed by the upper and lower panel first reliefs 30 and 50 (shown in FIGS. 2 and 3). This first fold, consisting of folding the outside surface of the lower panel upon itself, causes the upper panel outside surface to define both the top and bottom surfaces of the half-sized subassembly.

Figure 6:
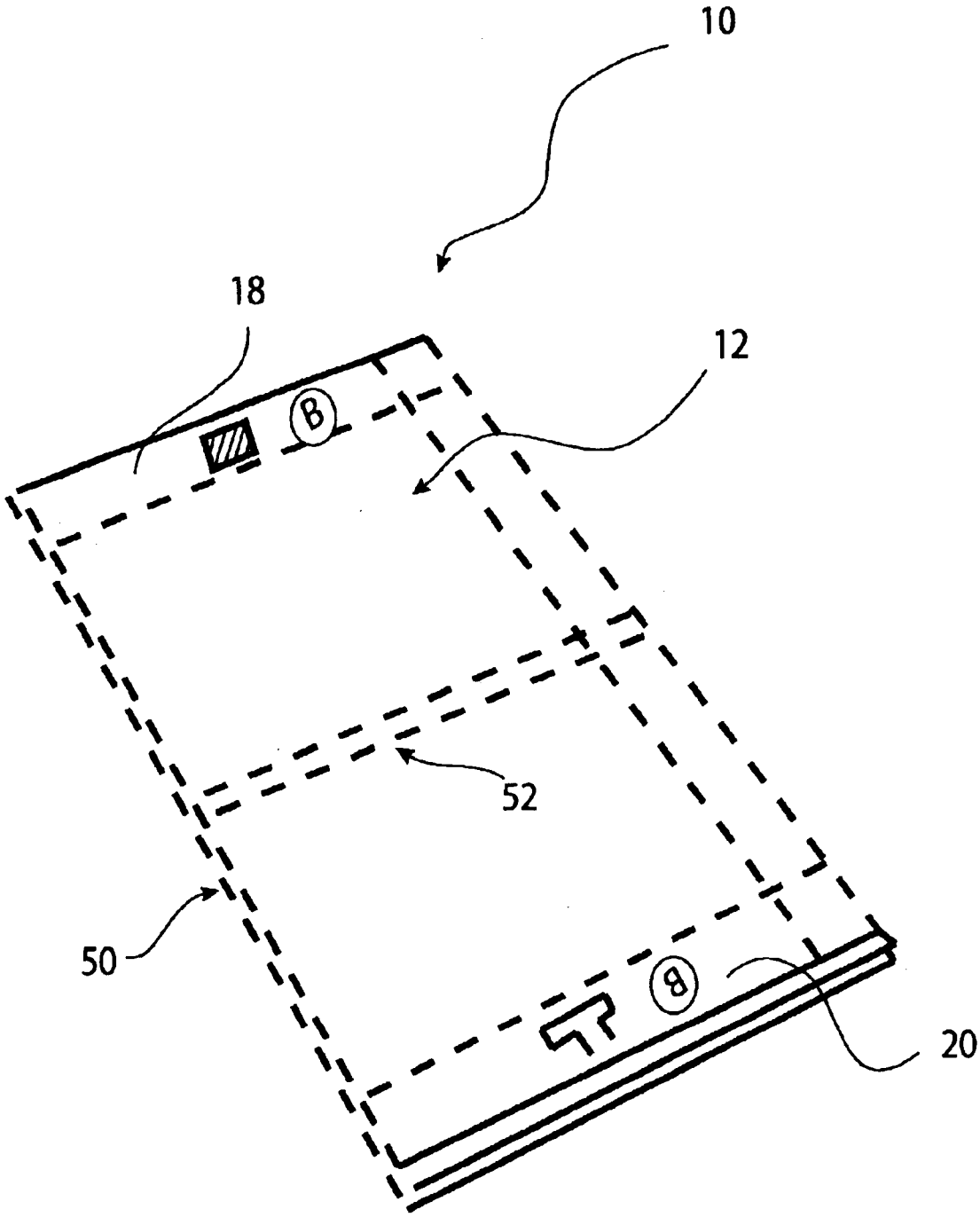
FIG. 6 is a top plan view of an outside surface of a first half of the upper panel of the collapsible food container of FIG. 4, after the upper panel and lower panels have been folded into half.
Figure 7:
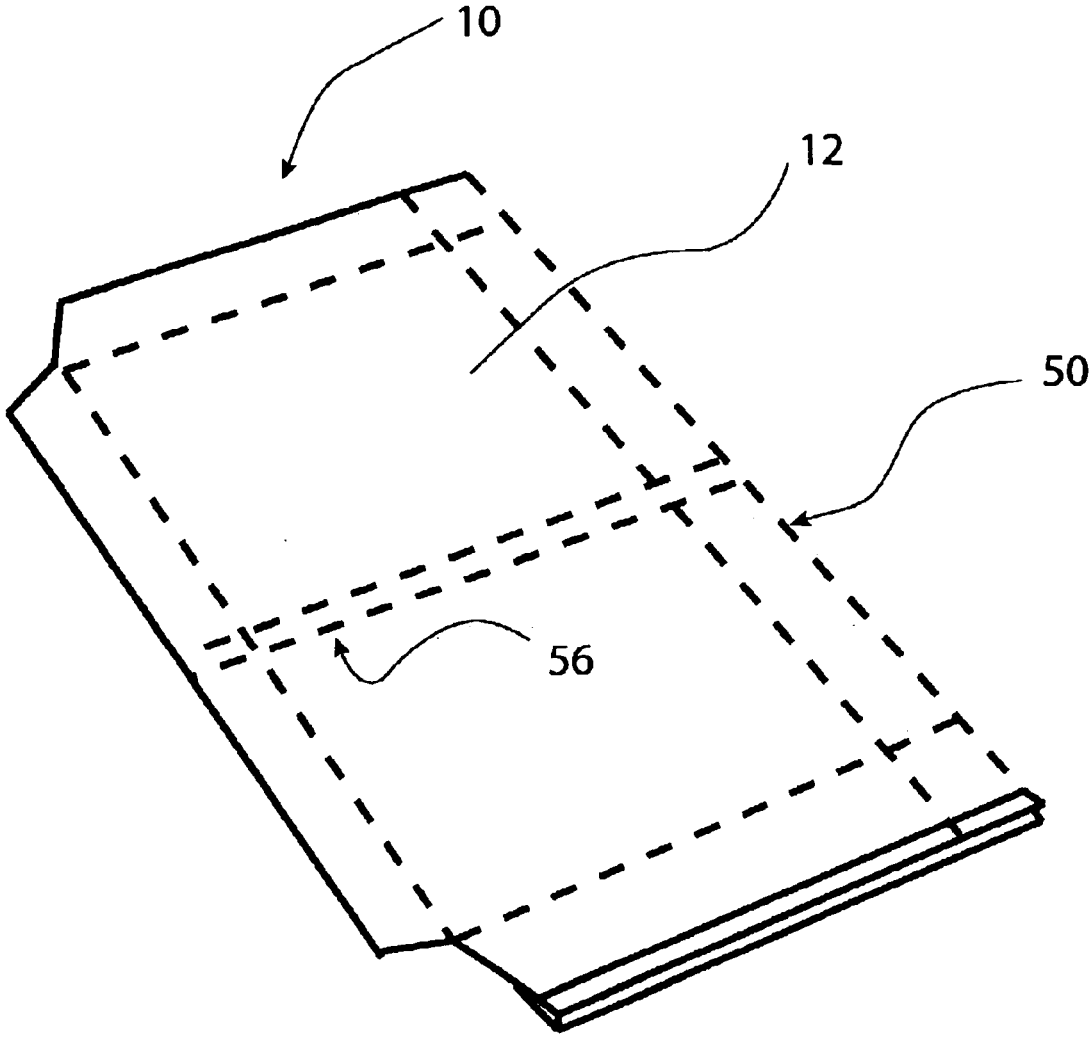
FIG. 7 is a top plan view of an outside surface of a second half of the upper panel of the collapsible food container of FIG. 4, after the upper panel and lower panels have been folded into half.

FIG. 6 illustrates the container 10 of this invention, looking downward onto a first half portion of the upper panel 12 outside surface after the container has been folded in half as described above, as facilitated by the upper panel first relief 50. FIG. 7 illustrates a second half portion of the upper panel 12 outside surface after the container has been folded in half about the first relief 50. Referring back to FIG. 6, the folded half container is next folded into a quarter of its assembled size by folding the outside surface of the upper panel 12 onto itself, along an axis defined by the upper panel second relief 52, by connecting point B on side panel 18 with point B on side panel 20. This second folding step is facilitated by the second fold areas formed by the cooperative placement and sacrificial action of the second relief sections of the upper and lower panels.

Referring to FIG. 6, the upper panel second relief 52 is positioned over the second relief of the lower panel, and operates to facilitate in inwardly directed folding, i.e., forming an inside edge, of the doubled container upon itself. Referring to FIG. 7, the upper panel second relief second section is positioned over the lower panel second relief second section and operates to facilitate an outwardly directed folding, i.e., forming an outside edge, of the doubled container upon itself.

Figure 8:
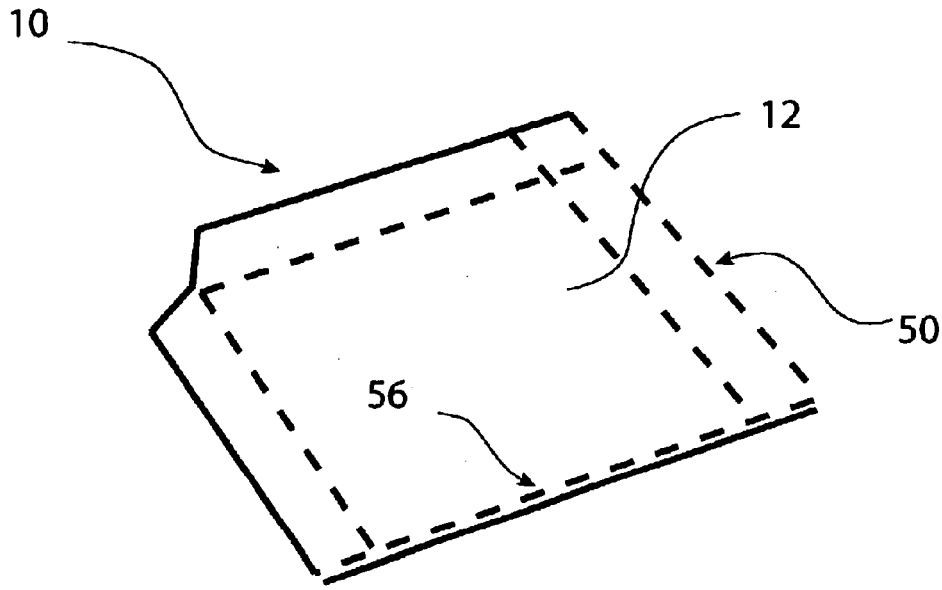
FIG. 8 is a top plan view of a first outside surface the upper panel of the collapsible food container of FIG. 7, after the folded in half upper panel and lower panels have again been folded in half.
Figure 9:
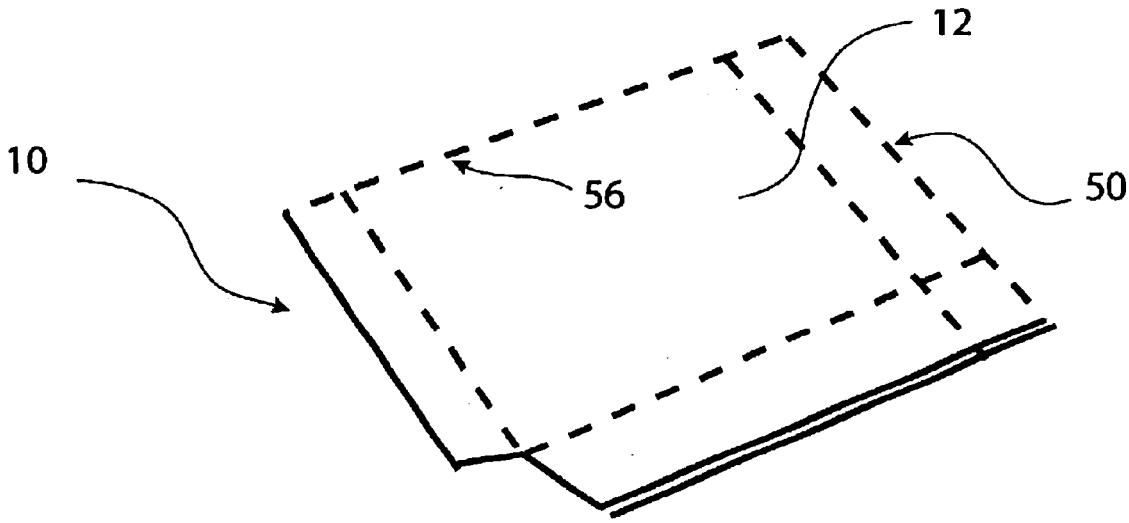
FIG. 9 is a top plan view of a second outside surface the upper panel of the collapsible food container of FIG. 7, after the folded in half upper panel and lower panels have again been folded in half.

FIG. 8 illustrates a first outer surface of the upper panel 12 of the container 10 of this invention after it has been again folded into half in the manner described above, i.e., along the second relief second section 56, thereby being reduced by approximately one quarter of its assembled size. FIG. 9 illustrates a second outer surface of the upper panel 12 of the container 10. Once the container is folded upon itself in the manner described above, the upper panel surfaces illustrated in FIGS. 8 and 9 define the opposed outer surfaces of the now completely collapsed container.

FIGS. 8 and 9 also operate to illustrate the dramatic reduction in space, when compared to the fully assembled container as shown in FIG. 1, that can be obtained for a container that is constructed in accordance with the principles of this invention, thereby operating to make handling of the container for disposal easier and less clumsy, and more space efficient. Such space efficient storage and disposal of garbage is especially desired and encouraged as it helps to conserve resources used to both transport and store the same, thereby being ecology friendly.

Figure 10:
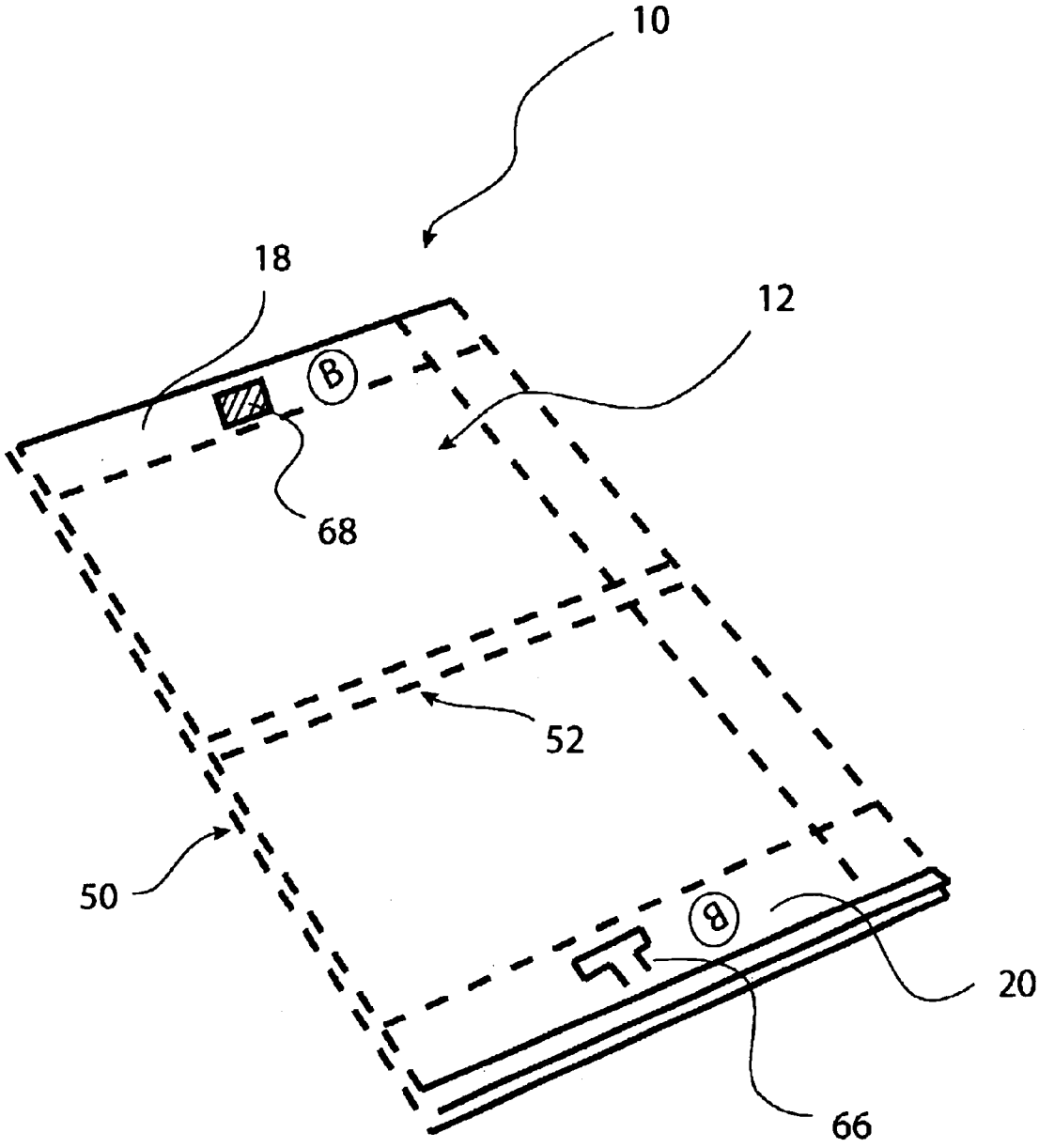
FIG. 10 is a top plan view of an outside surface of a first half of the upper panel of the collapsible food container of FIG. 4, after the upper panel and lower panels have been folded into half, and illustrating an integral attaching means.

Collapsible containers of this invention can also include one or more means for keeping the fully collapsed container in its most compact collapsed form. FIG. 10 illustrates outside surface portions of the upper panel 12 outside surface (similar to that illustrated in FIG. 6) before the container is again folded upon itself about the second relief by moving the side panels 18 and 20 towards one another. For purposes of keeping the container in a completely collapsed condition, one or more portions of the upper panel outer surface shown in FIG. 10 can be configured to provide such attaching means.

In an example embodiment, one or both side panels 18 and 20 can be configured having an attaching means. Such attaching means can be in the form of cooperative adjacent surface features, such as a tongue in groove, interference fit, or other conventional known attachment mechanism formed by cooperating attachment members. Alternatively, the attaching means can be in the form of an adhesive member positioned on one of more portion of the upper panel out surface, or can be in the form of a mechanical clip or pin, i.e., a non-integral member of the container, that is used to join the opposed adjacent upper panel outer surface sections together.

In an example embodiment, the attaching means is provided in the form of tongue in groove mechanism, wherein one of the side panels 18 or 20 comprises a tongue portion that is sized and shaped to cooperate with a groove that is disposed in the other one of the side panels 18 or 20. In a preferred embodiment, illustrated in FIG. 10, the tongue member is provided in the form of a tee- or arrow-shaped member 66 that is integral with the side panel 18, and the groove member is provided in the form of a slotted opening 68 that is formed in the side panel 20. Configured in this manner, when the container of FIG. 10 is folded its final time to one-quarter of its size, the tongue member 66 is placed into the adjacently positioned groove 68 to keep the container in its collapsed form.

Although particular embodiments of collapsible food containers have been described and illustrated, it is to be understood that other variants that make use of the same general principles are intended to be within the scope of this invention. For example, food containers having the first and second reliefs positioned differently on the upper and/or lower panels than described, that achieve a one quarters reduction in size, are intended to be within the scope of this invention.

Although collapsible food containers of this invention are preferably constructed to accommodate a one quarters size reduction, they can also be configured to provide only a one half reduction in size if such size reduction is deem sufficient. In the event that a one half size reduction is all that is desired, collapsible food containers of this invention can be embodied having only a first relief as noted above in one or both of the upper and lower panels. Additionally, a means for attaching the halved sections together, similar to that described above and illustrated in FIG. 10, can be used to keep the folded half sections together.

Although limited embodiments of collapsible food containers of this invention have been described herein, many modifications and variations will be apparent to those skilled in the art. Accordingly, it is to be understood that, within the scope of the appended claims, collapsible food containers of this invention may be prepared other than as specifically described herein.

What is claimed is:

1. A collapsible food container comprising:

an upper and lower panel comprising:

a leading edge at a front portion of each panel;

a trailing edge at a rear portion of each panel, the trailing edge of each panel being connected together by a rear panel interposed therebetween;

side edges that are opposite one another and that extend between the leading edge and the trailing edge of each upper and lower panel;

a first relief disposed along a surface of at least one of the upper or lower panels and extending along an axis running between opposed side edges to form a first fold area, the first relief being positioned near a midpoint between the leading edge and trailing edge to facilitate folding the container about the first area to reduce the size of the container by approximately one half; and a second relief disposed along a surface of at least one of the upper or lower panels and extending along an axis running perpendicular to the axis defining the first relief to form a second fold area, the second relief being positioned near a midpoint between the opposed side edges and comprising a section of spaced apart parallel perforations, the second relief facilitating folding the container about the second fold area to reduce the size of the container by approximately one quarter after the container has already been reduced in size by approximately one half by folding the container about the first area.

2. The container as recited in claim 1 wherein the second relief is provided along a surface of both the upper and lower panels, and wherein the second relief on each upper and lower panel includes the section of spaced apart parallel perforations.

3. The container as recited in claim 1 further comprising connecting members positioned adjacent portions of the container together when the container is folded two times about the first and second reliefs.

4. The container as recited in claim 3 wherein the connecting members are integral with the container.

5. The container as recited in claim 4 wherein the connecting members are provided on opposed surfaces of the container are configured having a tongue member and a cooperating groove member.

6. The container as recited in claim 1 wherein the lower panel further comprises a front side panel attached to its leading edge, and side panels attached to its opposed side edges, wherein the front side panel and side panels project outwardly in a perpendicular manner from the lower panel to form a box structure and a terminal edge of the front side panel is engaged with the lower panel to maintain such structure, wherein the front side panel includes means for disengaging the front side panel from the lower panel.

7. The container as recited in claim 1 wherein the first relief comprises perforations provided along an inside surface of the lower panel.

8. The container as recited in claim 7 wherein the first relief comprises perforations provided along an outside surface of the upper panel.

9. The container as recited in claim 1 wherein the second relief comprises perforations provided along an inside surface of the lower panel.

10. The container as recited in claim 9 wherein the second relief comprises perforations provided along an outside surface of the upper panel.

11. A collapsible food container comprising:

an upper and lower panel each being formed from a single-piece blank comprising:

a leading edge at a front portion of each panel;

a trailing edge at a rear portion of each panel, the trailing edge of each panel being connected together by a rear panel interposed therebetween;

side edges that are opposite one another and that extend between the leading edge and the trailing edge of each upper and lower panel;

a first relief disposed along a surface of at least one of the upper or lower panels and extending along an axis defined between the opposed side edges to form a first fold area, the first relief being positioned near a midpoint between the leading edge and trailing edge; and a second relief disposed along a surface of at least one of the upper or lower panels and extending along an axis that is perpendicular to the axis of the first relief to form a second fold area, the second relief being positioned near a midpoint between the opposed side edges and comprising a section of spaced apart parallel perforations;

wherein the first relief facilitates folding the container about the first area to reduce the size of the container by approximately one half, and wherein the second relief facilitates folding the container about the second fold area to reduce the size of the container by approximately one quarter after the container has already been reduced in size by one half by folding the container about the first fold area; and connecting members positioned adjacent portions of the container to cooperate with each other when the container is folded two times about the first and second reliefs.

12. The container as recited in claim 11 wherein the connecting members are integral with the container.

13. The container as recited in claim 12 wherein the connecting members are provide as a tongue member and a groove member, wherein opposed surfaces of the container are configured having the tongue member and the cooperating groove member.

14. The container as recited in claim 11 wherein the lower panel further comprises a front side panel attached to its leading edge, and side panels attached to its opposed side edges, wherein the front side panel and side panels project outwardly in a perpendicular manner from the lower panel to form a box structure and a terminal edge of the front side panel is engaged with the lower panel to maintain such structure, wherein the front side panel includes means for disengaging the front side panel from the lower panel.

15. The container as recited in claim 11 wherein the first relief comprises perforations provided along an inside surface of the lower panel.

16. The container as recited in claim 15 wherein the first relief comprises perforations provided along an outside surface of the upper panel.

17. The container as recited in claim 11 wherein the second relief comprises perforations provided along an inside surface of the lower panel.

18. The container as recited in claim 11 wherein the second relief comprises perforations provided along an outside surface of the upper panel.

19. The container as recited in claim 11 wherein the second relief is provided along a surface of both the upper and lower panels, and wherein the second relief on each upper and lower panel includes the section of spaced apart parallel perforations.

20. The container as recited in claim 1 wherein the second relief is provided along an inside surface of the lower panel and along an outside surface of the upper panel.

21. A collapsible pizza container comprising:

an upper panel having an upper front side panel and two opposed upper side panels defining three upper panel edges that each project orthogonally therefrom;

a lower panel having a front side panel and two opposed side panels defining three lower panel edges that each project orthogonally therefrom;

a rear side panel interposed between and hingedly attached to a fourth edge of each upper and lower panel, the upper and lower panels each being formed from a single-piece blank and further comprising:

a first relief disposed along an inside surface of the lower panel and along an outside surface of the upper panel, and extending along an axis running between the side panels, the first relief being positioned adjacent a midpoint between the front side panel and the rear side panel;

a second relief disposed along an inside surface of the lower panel and along an outside surface of the upper panel, and extending along an axis perpendicular to the first relief, the second relief being positioned adjacent a midpoint between the side panels and comprising a section that includes a pair of spaced apart parallel perforations; and wherein, when the container is in an assembled state, the upper and lower panels are positioned parallel to each other with the respective front side panels and respective two side panels of the upper and lower panels being positioned adjacent one another; and wherein the first and second reliefs provide respective first and second fold areas to fold the container into one quarter of its assembled size.

22. The container as recited in claim 21 further comprising means for attaching folded sections of the container together when the container is folded into one quarter of its assembled size.

23. The container as recited in claim 22 wherein the attaching means is integral with one or both of the upper and lower panels.

24. A method for collapsing a food container including an upper panel having an upper front side panel and two opposed upper side panels defining three upper panel edges, the upper front side panel and two upper side panels being integral with the upper panel, a lower panel having a front side panel and two opposed side panels defining three lower panel edges, the lower front side panel and two lower side panels being integral with the lower panel lower, and a rear side panel interposed between and integral with a fourth edge of each upper and lower panel, the rear side panel connecting together and enabling movement of the upper and lower panels relative to one another, in an assembled state the upper and lower panels being positioned parallel to each other with the respective front side panels and respective two side panels of the upper and lower panels being positioned adjacent one another, the method comprising the steps of:

folding the assembled container in approximately half about a first relief disposed along at least one of the upper and lower panels, and placing the opposed container half sections close to one another; and folding the container half sections in approximately half about a second relief disposed at least one of the upper and lower panels and positioned perpendicular to the first relief, at least a section of the second relief including a section of spaced apart parallel perforations.

25. The method as recited in claim 24, further comprising the step of securing together finally folded container sections by connecting members that are integral with the container.

* * * * *